US005744919A

United States Patent [19]

Mishin et al.

[11] Patent Number: 5,744,919

[45] Date of Patent: Apr. 28, 1998

[54] CW PARTICLE ACCELERATOR WITH LOW PARTICLE INJECTION VELOCITY

[76] Inventors: Andrey V. Mishin, 6559 Leyland Park Dr., San Jose, Calif. 95120; Russell G. Schonberg, 12386 Melody La., Los Altos Hills, Calif. 94022

[21] Appl. No.: 764,535

[22] Filed: Dec. 12, 1996

[51] Int. Cl.[6] ..... H05H 9/00; H05H 7/00

[52] U.S. Cl. ..... 315/505; 315/500

[58] Field of Search ..... 313/505, 500, 313/5.41, 5.42, 5.46, 5.47

[56] References Cited

U.S. PATENT DOCUMENTS

| | | | |
|---|---|---|---|
| 5,021,741 | 6/1991 | Kornely, Jr. et al. | 315/505 |
| 5,179,350 | 1/1993 | Bower et al. | 315/505 |
| 5,578,909 | 11/1996 | Billen | 315/505 |

*Primary Examiner*—Sandra L. O'Shea
*Assistant Examiner*—Jay M. Patidar
*Attorney, Agent, or Firm*—Ron Fish; Falk & Fish

[57] ABSTRACT

An RF linear accelerator using CW or low amplitude pulsed RF excitation which can efficiently accelerate charged particles from 0.1 C to relativistic velocities in excess of 0.9 C. A charged particle source feeds charged particles having velocities of about 0.1 C into a first type RF LINAC having a plurality of side coupled resonator cavities each having a drift tube in the middle. The RF length of the cavities is set relative to the velocity of the particles and the RF excitation wavelength such that the particles experience in-phase accelerating E fields in the gaps on either side of the drift tube and are shielded from decelerating E fields while inside the drift tubes. The RF coupling cavities establish sufficient phase change between adjacent resonators such that the particles arrive in the adjacent resonator cavities in synchronization with oscillations in the standing wave therein so as to experience further acceleration. The first RF LINAC accelerates the particles to 0.5 C approximately. The charged particles are then passed through a conventional RF LINAC with a CW source which is optimized to accelerate the particles from 0.5 C to relativistic velocities. A variable phase change RF coupler couples the RF between the first RF LINAC and the second RF LINAC such that a variable degree of synchronization can be achieved such that the energy of the particle beam exiting said second RF LINAC can be modulated by varying the phase change. A conventional CW RF LINAC is also disclosed with a duty cycle controlling system for operating the RF and charged particle sources with variable duty cycles so as to achieve control of average beam power and enable higher momentary beam energies than would otherwise be the case for CW LINACs.

26 Claims, 3 Drawing Sheets

CW PARTICLE ACCELERATOR WITH LOW PARTICLE INJECTION VELOCITY

BACKGROUND OF THE INVENTION

The invention pertains to the field of particle accelerators, and, more particularly, the field of low cost CW particle accelerators using low injection velocities, high efficiency of acceleration and high output beam energy.

Conventional particle accelerators have difficulty in efficiently accelerating low velocity particles having injection velocities in the range from 0.1 C (one-tenth the velocity of light) to 0.5 C using CW (continuous wave) RF sources having low E field (electric field) intensity. High output beam power is a highly desirable result for a linear particle accelerator because such beams have many practical uses. For example, such beams are useful for irradiating malignant tumors, for the generation of x-rays and for e-beam cross-linking of polymers. Beam power is equal to:

$$P_B = WI_{OV} \tag{1}$$

where $P_B$=beam power

W=beam energy, and $I_{OV}$=average beam current.

Beam energy is equal to the average electric field intensity E generated in the acceleration cavity by the RF source times the length of the accelerator structure over which the E field acts on the particles being accelerated. More precisely, beam energy is:

$$W = eEL \tag{2}$$

where e=charge of particle

E=field strength of the electric field generated by the RF source

L=length of the accelerator.

E field intensity is proportional to the square root of the power of the RF source, More precisely, E field intensity is:

$$E = \sqrt{(RP)L} \tag{3}$$

where

R=an axis impedance of the accelerator cavity in Ohm/meter (m) proportional to Q (quality factor) and inversely proportional to the square root of λ.

λ=wavelength of the power source

P=the power output of the RF source in Watts, and

Q=the Q factor of the accelerator cavity is described by equation (4) below.

L=length of the accelerator $$Q = \omega \frac{W_S}{P_{DIS}} \tag{4}$$

where

ω=the angular frequency of the RF source $W_S$=the energy stored in the structure, and $P_{DS}$=the RF power dissipated in the structure caused by losses in the cavity from skin effect on the walls and disks therein.

Therefore, higher power RF sources generate greater E field intensity and, for any given length of accelerator, the result is higher output beam energy.

CW RF sources are not high power. CW RF sources range in power from tens to hundreds of kilowatts. As a result, linear accelerators which generate high beam powers have, in the prior art been forced to use high power pulsed RF sources such as Klystrons. Typically, one Klystron is used to power each accelerator section. Each Klystron is an amplifier requires an RF or microwave source to act as a driver.

While it is possible to use CW Klystrons in linear accelerators, because of their lower average power, such linear accelerators require high velocity particles at the input of the accelerator cavities. Typically such CW accelerators require particle injection velocities of at least 0.5 C. This is because CW RF sources in conventional linear accelerator structures are not efficient in accelerating particles in the range from 0.1 C to 0.5 C.

Unfortunately, Klystrons and their associated modulators are expensive. A typical Klystron with 30 KW average power and 5 MW (megawatt) peak power costs about $70,000. The modulator that generates and forms the RF bursts including a high voltage, high power supply costs about $400,000.

CW RF sources are much cheaper because they generate a much lower average power. Unfortunately, this lower average power of a CW source results in a lower E field intensity. This makes it extremely inefficient and costly to accelerate low velocity particles using a CW source in a linear accelerator of conventional design. The reason for this is that although the average E field intensity is constant over the length of the accelerator, the velocity of the particles does not rise linearly and remains low for most of the length of the accelerator. FIG. 1 helps in understanding this problem. FIG. 1 is a comparison of the rise in beam energy over the length of the accelerator for pulsed versus CW RF sources with a particle velocity overlay. From Equation (2), it is clear that the beam energy rises linearly with length and the slope is set by the average E field intensity acting over that length. Line 10 represents the rise in beam energy for a pulsed RF source whereas line 12 represents the rise in beam energy for a CW RF source. The higher beam energy at the output (line 14) for the pulsed RF source results because of the higher average power of pulsed RF sources resulting in higher average E field intensity. Dashed line 16 represents an overlay illustrating low particle velocity varies over the length of the accelerator. Particle velocity is very low and remains quite low for the majority of the length of the accelerator assuming a particle beam energy at the input of about 12 KeV and an output beam energy of 1 MeV, which, for electrons, translates to input particle velocities of about 0.2 C and an output velocity of about 0.92 C. The reason for this nonlinear velocity increase lies in the mathematical relationships governing motion of a charged particle in an electric field. Velocity of a charged particle after traversing a segment of E field of potential difference V is:

$$eV = mc^2\gamma \tag{5}$$

where e=charge of the particle eV=particle energy m=the mass of the particle, and c=the velocity of light γ=relativistic factor.

Since potential difference is equal to the length of movement of a charged particle in an electric field, the velocity characteristic symbolized by line 16 in FIG. 1 is a square low relationship with the velocity growing as the square of the distance travelled.

These low particle velocities in the first portions of the accelerator cause huge inefficiency problems, and, in the past, have generally ruled out the use of cheaper CW RF sources for radio frequency linear accelerator (RF LINACs) cavities in which the velocity of the particles was between 0.1 C and 0.5 C. The reason for this is that RF LINACs depend for their operation on synchronism between the movement of the particle through the accelerator and oscillations of the E field standing wave therein. This concept is explained in more detail in Scharf, "Particle Accelerators and Their Uses", p. 121 et seq. (Harwood Press, London 1986) ISBN 3-7186-0034-X, which is hereby incorporated by reference. Generally though, the idea is to synchronize the passage of particles through gaps of a coaxial system of cylindrical electrodes or in the electric field of an electromagnetic standing wave or a travelling wave such that the E field variations in a particular spatial area of the accelerator are such as to accelerate the particle as it passes through that spatial area.

Obviously high energies can be obtained by using long accelerators, but for machines used industrially such as in medical and manufacturing environments, the accelerator must be kept short to be of practical size and of reasonable cost. Accelerators must be shielded and shielding is expensive. Thus, shorter, high beam power accelerators are desired since they are cheaper and more practical. However shorter accelerators heretofore required higher E field intensities, and that translates to higher RF power supply costs.

Cheaper CW sources could not be used for low injection velocity RF LINACs because of low E field intensity and high losses. To achieve proper synchronization, the "period", i.e., length, of each acceleration cavity had to be set in accordance with the velocity of the particles. The period of the cavities is defined by the end walls that define the acceleration gaps. AT low particle velocities, these walls have to be moved closer together. Shunt impedance is a loss factor and is proportional to the number of walls per unit length. Larger numbers of walls per unit length lowers the shunt impedance which increases losses because of greater skin effect losses. Thus, cheaper CW RF sources of low amplitude heretofore could not be used to accelerate low velocity particles. Therefore a need arose to find a way to efficiently accelerate low injection velocity particles using low cost CW RF sources of low amplitude using an accelerator of reasonable length to achieve high output beam power.

A structure using a single $E_{010}$ type cavity coupled to a conventional side coupled accelerator structure using three banana shaped coupling slots in the iris separating the $E_{010}$ type cavity from the rest of the structure was built with a pulsed RF source in 1993 for a company called Intraop. This structure required a specific electric field configuration in the $E_{010}$ type cavity between the injection point and the first iris of the particles to work properly. This specific field configuration is difficult to model and it makes the output beam characteristics more sensitive to the field amplitude in the first $E_{010}$ type cavity than is the case for the invention described herein. This electric field configuration from the Intraop structure is not required in the invention described herein. Further, the invention described herein can achieve high output beam energy efficiently using a CW RF source even though the velocities of the injected particles is lower than can be efficiently accelerated using pulsed RF sources. The Intraop structure cannot use a CW source because the cavity parameters are not correct for such a low amplitude power source as a CW RF source.

SUMMARY OF THE INVENTION

According to the teachings of the invention, a high output beam energy is achieved using a low amplitude CW RF source and a low particle input injection velocity. This result is achieved by coupling a charged particle source to the input of an RF linear accelerator having two different sections each of which is comprised of multiple acceleration cavities coupled by coupling cavities. The two sections of the accelerator are coupled by a phase shifting coupler to establish accelerated particles leaving the first section on the E field of the second section in the proper phase relationship to continue the acceleration. Both sections of the accelerator resonate with RF energy supplied by either a CW or pulsed RF source. The fact that the RF source can be a low amplitude CW source without degrading the performance of the accelerator is an important aspect of the invention.

The first section of the accelerator is specially designed to be able to accelerate low velocity particles having velocities in the range from 0.1 C to 0.5 C using a CW source. In the case of electrons, the output energy from the first section is about 80 KeV. The second section of the accelerator is designed to accelerate particles having velocities from 0.5 C to relativistic velocities. The output energy of particles from the second section can be any value typically from 1–20 MeV.

DETAILED DESCRIPTION OF THE PREFERRED EMBODIMENT

Figure 1:
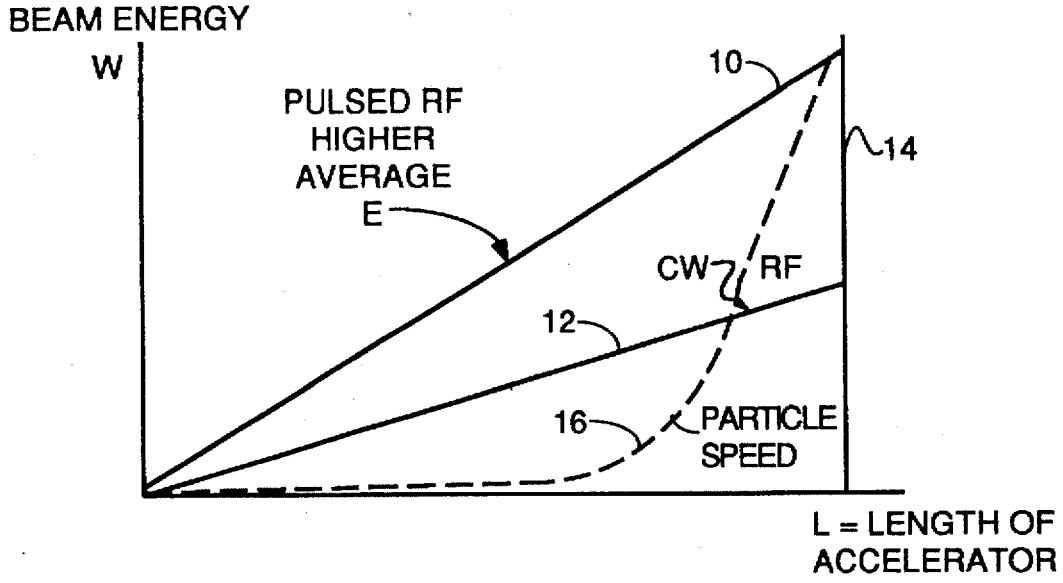
FIG. 1 is a diagram showing the principal difference in the linear rise in energy of particles in RF pulsed LINACs versus RF CW LINACs.
Figure 2:
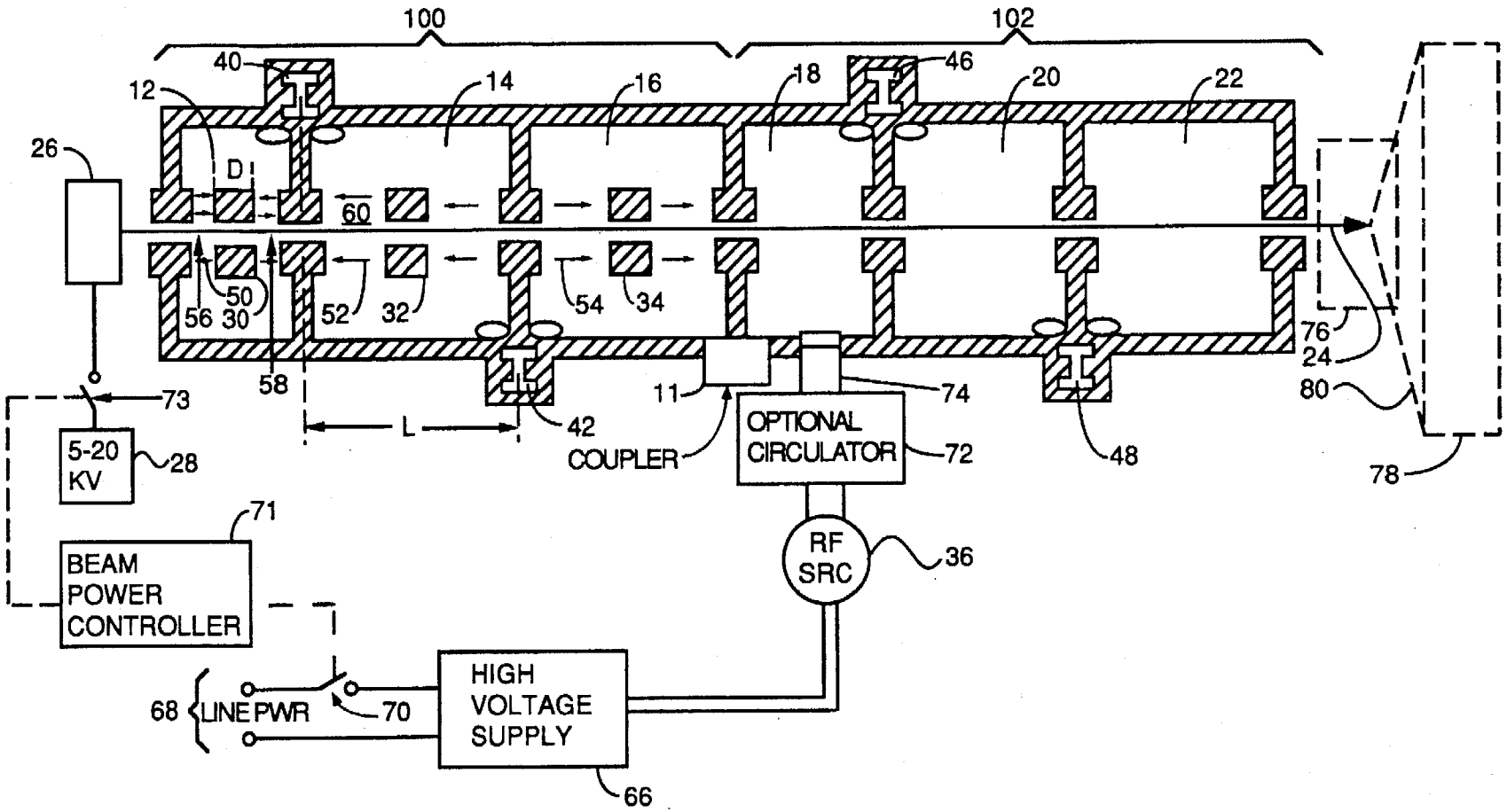
FIG. 2 is a cross-sectional diagram of an RF linear accelerator according to the teachings of the invention.

Referring to FIG. 2, there is shown a cross-sectional view of an RF linear accelerator according to the teaching of the invention. The accelerator is comprised of a first, low-velocity section comprising one or more resonator cavities. In the embodiment shown in FIG. 2, three resonator cavities 12, 14 and 16 to the left of coupling, phase-shifting device 11 are shown, and a second, high-velocity section comprising three resonator cavities 18, 20 and 22 to the right of coupling, phase-shifting device 11. Hereafter, these two sections will be referred to as the low velocity accelerator and the high velocity accelerator, respectively.

All the resonator cavities of the low velocity and high velocity accelerators are cylindrical cavities defined by end walls with holes in the center for passage of the accelerated particle beam 24. Hereafter these end walls will be referred to as irises.

Although the irises at the ends of the accelerator structure of FIG. 2 appear to leave the internal cavities open to the air, in an actual accelerator constructed according to the teachings of the invention is evacuated so the end irises actually form vacuum seals with the structures coupled to each end of the accelerator.

A charged particle source 26 introduces charged particles such as electrons or protons into the first accelerator cavity 12 of the low velocity section. The charged particle source is powered by a high voltage source 28. Since the low velocity section is capable of efficiently accelerating charged particles in the low velocity range from 0.1 C to 0.5 C with a CW RF source, the charged particles input by the charged particle source 26 do not need to be very energetic. Therefore, the charged particle source can be any of a plurality of different, known sources capable of supplying charged particles at a velocity of about 0.1 C. A gridded electron gun allowing grid control or grid modulation of the input beam is an example of one such source 26 and is preferred.

The low velocity section has the same general structural and physical properties defined in Russian Patent 1577678 field Dec. 1, 1988 and issued Mar. 8, 1990, the contents of which are hereby incorporated by reference. The basic idea behind the low velocity section is to couple together a series of Alvarez-type accelerator cavities through phase shifting or coupling cavities. Each of cavities 12, 14 and 16 is cylindrical and has a drift tube in the center centered on the particle beam axis such that the beam passes the drift tube. Specifically, cavity 12 has a drift tube 30, cavity 14 has drift tube 32, and cavity 16 has drift tube 34 therein.

The purpose of the drift tubes is to provide a shield for the traveling particles in the portions of the cavity in which they find themselves when variations in the E field of the $TM_{010}$ mode excited by RF source 36 in the region of the drift tube would cause deceleration. The period of the structure with on-axis coupling in the low velocity section is set according to Equation (6) below:

$$L=\frac{5\beta\lambda_o}{2} \tag{4}$$

where

L=period of structure defined as the distance from the middle of one coupling cavity to the middle of the next coupling cavity, as indicated in FIG. 2, β=the average velocity of the charged particles in the cavity in meters per second divided by the velocity of light in vacuum, and $\lambda_O$=the wavelength of the RF excitation energy from RF source 36.

The drift tubes 30, 32 and 34 each have a length set according to Equation (7) below (in the preferred embodiment):

$$D=0.5\pm0.15(\beta\ \lambda_O) \tag{7}$$

where

D=the length of the drift tube and β and $\lambda_O$ are as defined for Equation (6). Generally, the best length for the drift tube is $0.5(\beta\ \lambda_O)$. However, in other embodiments, the drift tubes can have different lengths to optimize acceleration depending upon the transit time factor through the accelerating gaps. That is, the drift tube length can be optimized based upon transit time factors. Basically, optimization of the acceleration process depends upon the intersection of two functions. One function relates the change of intensity of the electric field in the gaps to the changing length of the drift tube causing a changing acceleration gap distance between the end of the drift tube and the next iris or wall in the structure. The other function relates the transit time to the acceleration gap distance. By varying the length of the drift tube to lengths slightly longer or shorter than $0.5(\beta\ \lambda_O)$, it is possible to increase or decrease the acceleration that occurs in the gap from the amount of acceleration that occurs with the drift tube length set at $0.5(\beta\ \lambda_O)$. In fact, drift tube length variations greater than $\pm0.15(\beta\ \lambda_O)$ still fall within the teachings of the invention depending upon the application to which the output beam will be put.

The length L of the accelerating cavities 12, 14 and 16 is $L=3/2(\beta\ \lambda_O)$ in the preferred embodiment. This length can become the period of the structure when the coupling cavities are removed from the beam axis as in the side-coupled structure of FIG. 2. Of course the length of the Alvarez cavities can be set to any length, i.e., any number of complete cycles of the standing wave can be included within the confines of the cavity. In the case where more than one standing wave peak is included within the cavity, an appropriate number of drift tubes must be included in the cavity for shielding the particles from the fields at certain locations as is done in any Alvarez cavity.

When the velocity of the particles, excitation energy wavelength and cavity/drift tube dimensions are related as defined in Equations (6) and (7), synchronism between the movement of the particles and the RF field variations is achieved to provide acceleration. Specifically, the structure of the low velocity section is set according to Equations (6) and (7) such that, within the adjacent gaps of each acceleration cavity separated by a drift tube, the RF fields oscillate in a co-phase relation. Likewise, the fields in adjacent acceleration cavities separated by coupling cavities 40 and 42 oscillate in an antiphase relationship. As the charged particles fly through the adjacent acceleration cavities (sometimes also referred to herein as resonators), they interact with the axial component of the electric field and acquire energy therefrom and pick up velocity.

In some embodiments, the drift tubes may be supported in the centers of the resonators by disks. These disks have magnetic field coupling slots formed therein outside the position of the drift tube to provide a strong coupling for the fields.

Although the low velocity and high velocity structures in FIG. 2 are shown as having resonators 12, 14, 16, 18, 20 and 22 side coupled by coupling cavities 40, 42, 46 and 48, and phase shifting, coupling device 11, those skilled in the art will appreciate that the structure could also be on-axis coupled. The purpose of the coupling cavities is to act as spacers/phase changers such that the charged particles enter each acceleration gap in a resonator in the proper phase of the RF field variations in that gap so as to be further accelerated. The phase shift provided by the coupling cavities 40 and 42 is Π/2 or 90° so as to obtain a phase shift of Π or 180° between adjacent accelerating cavities. For example, the orientation of the axial components of the E fields in the low velocity structure acceleration gaps at a particular instant in time is represented by arrows such as arrows 50, 52 and 54 in FIG. 2. At a time Π radians later (time measured according to the angular frequency of the RF excitation wave with 2Π radians equalling one cycle or 360°), the orientation of these arrows is reversed. The purpose of sizing the cavities and drift tubes in accordance with the velocity of the particles and the wavelength of the RF excitation energy and using coupling cavities between resonators is to maintain synchronization. That is, the charged particles are accelerated in gaps 56 and 58 by the left-to-right orientation of the E field and are shielded from deceleration by an E field from right to left in the center of the resonator 12 by drift tube 30. After the particles pass through gaps 56 and 58 and drift tube 30, they enter gap 60 in resonator 14. The purpose of coupling cavity 40 is to insure that there is a sufficient phase change between gap 58 and gap 60 (Π/2 or 90°) such that by the instant the charged particles enter gap 60, the orientation of the E field in gap 60 will have reversed itself from that represented by arrow 52 and will be oriented from left to right.

Phase change in an RF LINAC is achieved by adding distance into the RF path since the $TM_{010}$ mode is basically a standing wave. Side coupling is preferred to on-axis coupling because it shortens the overall accelerator length while still achieving the desired phase change between each resonator. Shorter accelerators are cheaper to build since less shielding is required and fewer components are necessary. Shielding is required for all accelerators and it is expensive to build. Side coupling adds distance to the path the RF sees while not adding distance to the path the beam travels. Since it is only necessary to add distance to the RF path to achieve the desired phase change, side coupling works. The dimensions of the coupling cavities are established by choosing the right resonant frequency of the coupling cavity to provide a $\pi/2$ phase shift per cavity so as to provide a $\pi$ phase shift per accelerator cavity, and to provide proper mode separation.

Side coupling has the added benefit of improving the shunt impedance characteristic of the accelerator. Shunt impedance is a factor which characterizes acceleration efficiency, and it depends upon many factors, one of which is the number of walls per unit length of the beam path. If the coupling cavities are on-axis, the number of walls per unit length increases thereby lowering the shunt impedance and degrading the performance of the accelerator somewhat.

Figure 3:
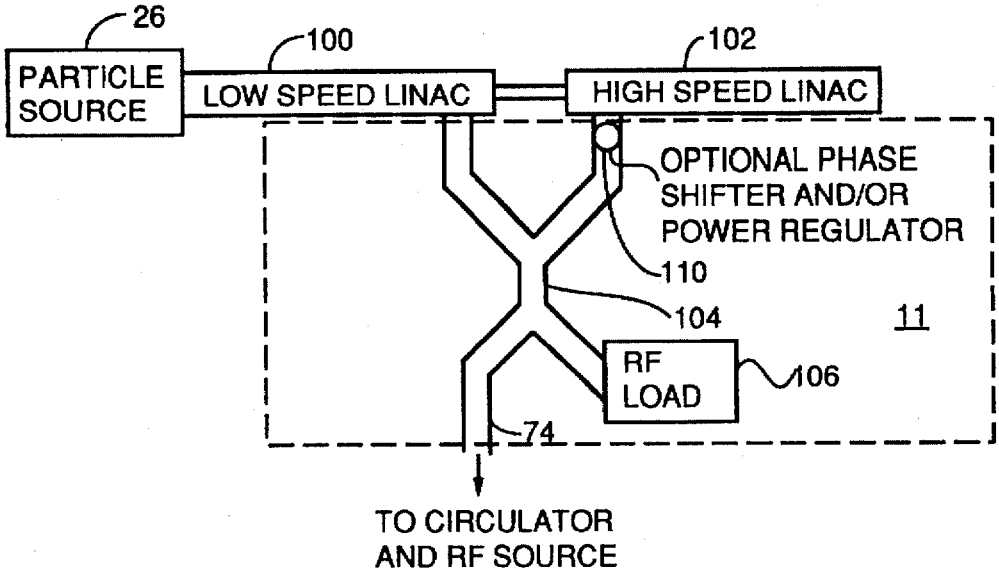
FIG. 3 is a schematic view of an alternative embodiment where a power splitter is used to couple CW or low pulse amplitude RF into an RF LINAC comprised of a low velocity section and a high velocity section.

The coupling device 11 functions to change the RF path length sufficiently such that accelerated particles leaving resonator 16, the last resonator in the low velocity section, enter resonator 18 of the standing wave high velocity RF LINAC in proper phase with the RF field oscillations in cavity 18 so as to be further accelerated (for maximum acceleration applications). In fact, the coupling device 11 can also be placed between two of the high speed type cavities so as to divide the accelerator into two sections, the section to the left of the coupler being called the low speed section but actually being comprised of two different types of accelerators cavities some of which include drift tubes and some of which do not. The function of the coupling device 11 remains the same in this alternative embodiment in that the coupler 11 must provide a correct phase relationship between the neighboring cavities to get the desired result (deceleration may actually be a desired result in some applications). Coupling device 11 can be implemented using any microwave transmitter such as a coupling cavity, a regulated phase shifter and/or attenuator or a power splitter such as a power splitter. The power splitter embodiment for coupler 11 is shown in FIG. 3. Any microwave transmitting device which can optimize the power/phase ratio between the low velocity and high velocity sections of the accelerator will suffice.

In some applications, it is desirable to be able to control the output energy of the beam other than by controlling the duty cycle of the RF source and the charged particle source. In such embodiments, symbolized by FIG. 3, a power splitter 104 combined with an optional phase shifter and/or power regulator 110 in one branch of the power splitter can be used to control the output beam parameters. Variable phase shifter 11 can either maximize the acceleration or "detune" the phase of the fields in the high speed accelerator such that charged particles do not arrive precisely in synchronization with the maximum amplitude E field in resonator 18. A variable phase shifter is not the preferred way of controlling output beam power though because of "energy spread", i.e., the fact that not all the particles entering the first cavity of the high speed LINAC have the same energy. Because of this fact, trying to control output beam power by varying the phase shift can cause loss of synchronization thereby negating the ability of the high speed LINAC section 102 to accelerate the particles. If beam power is to be controlled using the coupling structure 11, it is preferred that element 110 be a phase shifter to provide the proper phase shift between the last cavity 16 of the low speed LINAC 100 and the first cavity 18 of the high speed LINAC, and then use a power regulator to control the beam power. The power regulator portion of element 110 alters the amplitude of the RF excitation entering the high speed LINAC section 102 thereby causing a degree of acceleration of all particles, regardless of their energies, which varies with the amplitude of the RF excitation in the high speed LINAC. The optional phase shifter and/or power regulator 110 can vary power into the high speed accelerator section thereby changing the output beam parameters. This is useful in medical and many other applications. For example, in medical applications where tumors are being irradiated and the beam energy must be precisely set to control the beam penetration through the body so as to only reach the tumor being irradiated and not healthy tissue beyond the tumor.

Variable or regulated phase shift can also be obtained when a power splitter is substituted for coupler 11 and the RF source 36. An example of such a structure is shown in FIG. 3. FIG. 3 is an RF linear accelerator comprised of a low velocity LINAC section 100 and a high velocity RF LINAC section 102 each fed by a single RF source 36 through a power splitter 104. The high and low velocity linear accelerators and the RF source are of the same structure as previously discussed as is the particle source 26. An RF load 106 having the characteristic impedance of the resonators is coupled to one branch of the power splitter 104 to absorb reflected power. The power splitter allows RF power from the source to be split between two waveguide sections coupled to the low velocity and high velocity sections respectively in a predetermined and, in some embodiments, variable ratio. The power splitter is also used to control the relative phase shift between the output of the low velocity RF LINAC and the input of the high velocity LINAC, and this phase shift can be made variable in some embodiments to provide the ability to modulate the beam power. In addition the relative RF power fed to each of sections 100 and 102 as well as the relative phase relationship between the output of section 100 and the input of section 102 could be regulated in addition to being variable with a suitable, known power splitter structure.

The high velocity section of the accelerator would not be efficient in accelerating the low velocity particles injected by the charged particle source 26. This is because the resonator cavities 18, 20 and 22 would have to be much shorter to maintain synchronization thereby bringing the end walls of the cavities much closer together. This would raise the number of walls per unit length along the beam axis to a higher number thereby increasing skin effect losses and lowering the shunt impedance and Q factor. Lower Q factor translates to lower E field intensity and lower acceleration per unit length, and this is true with both pulsed and CW RF sources. However, because the average E field intensity of a CW source is much lower than for a pulsed source, accelerating slow particles in the 0.1 C to 0.5 C range using the conventional resonator cavities like resonators 18, 20 and 22 using a CW source is difficult, inefficient and overly expensive.

In contrast, the accelerator structure of FIG. 2 accelerates the low velocity particles with a structure that is efficient in the 0.1 C to 0.5 C range using a CW RF source and injects the accelerated particles travelling at 0.5 C into the conventional high velocity structure in the proper phase to further accelerate them using the same CW RF source used by the low velocity structure. Resonators 18, 20 and 22 are of conventional design well known to those skilled in the art and will not be further described here. Although side coupling is shown and preferred for the high velocity section, on-axis coupling could also be used. RF linear accelerators are described in the following references, all of which are hereby incorporated by reference.

1) A. V. Mishin, Ph.D. Thesis, Moscow Engineering Physics Institute, Moscow, 1992.
2) A. V. Mishin, "Accelerator Structures For Low Energy Electron Beam", Proc. of the PAC 93, Wash., D.C., pp. 971–973, 1993.
3) A. V. Mishin, R. G. Schonberg, H. Deruyter, T. Roumbanis, "Interoperative X-band Accelerator Microwave Structure Design", Proc. of EPAC94, pp. 2185–2187, London, 1994.
4) James H. Billen, Frank L. Krawezyk, Richard L. Wood and Lloyd M. Young, "A New RF Structure For Intermediate-Velocity Particles", Proc. of LINAC94, pp. 341–345, 1994.
5) A. V. Mishin, "Design and Application of Microwave Structure for Low Velocity Particles", Proc. of LINAC96, pp. 341–345, Geneva, IEEE, 1996.
6) A. S. Alimov, et al., "Compact Two Section CW Electron LINAC with High Beam Power", Preprint INP MSU-94-34/356, Moscow, 1994.

In FIG. 2, the RF source 36 is preferably a CW microwave source, but in alternative embodiments, it could also be a low peak power pulsed source. Low peak power pulsed sources are not as expensive as high peak power pulsed RF sources. The RF source is powered by a high voltage power supply 66 which can also include a modulator if pulsed power is used. The high voltage supply receives power from the A.C. power lines 68 through switch 70. Switch 70 is opened and closed by a beam power controller 71. This beam power controller also controls the opened or closed state of a switch 73 that enables and disables the charged particle sources 26 by controlling the power supplied thereto. The beam power controller can be operated to control the average beam power by controlling and synchronizing duty cycles of the charged particle source 26 and the RF source 36. In other words, intermittent pulsed operation can be achieved by the beam power controller simultaneously closing switches 70 and 73 to fill the accelerator with RF energy and simultaneously inject charged particles into the accelerator. In the preferred embodiment, the switches 70 and 73 are triacs, and the beam power controller can be a computer or any other circuit that turns both switches on in accordance with a duty cycle to achieve the desired output beam power. In some embodiments, the beam power controller can be more sophisticated in turning on switch 70 first, and then waiting some short time while the cavities fill with RF power and then turning on switch 73. Since the charged particles are accelerated mainly during the peaks of the RF power pulses, injection is done only during these times.

The beam power controller 71 and switches 70 and 73 represent an optional structure and, are not required to practice the basic structure of the invention of two LINACs which are structured to each accelerate different speed particles using a shared CW RF power source. The presence of the beam power controller 71 and switches 70 and 73 gives the system added utility however in several respects. First, the beam power controller, by enabling modulation of the duty cycles of the RF power source and the charged particle injection source enables control of the average beam power. Second, by operating a CW source only intermittently, higher beam energy is possible than with CW sources operated continuously. Higher beam energy widens the array of applications to which the charged particle accelerator can be put. Finally, operating the accelerator with a CW source which is enabled intermittently with RF pulse lengths that are very long compared to the typical pulse lengths of pulsed RF sources increases the efficiency of the accelerator. This is because the "fill time" and "decay time" which translate roughly to the rise and fall times of the RF pulses.

As to the first advantage of using beam power controller 71, average beam power is proportional to average beam current. Since the charged particle source is turned on by the beam power controller only when the RF source is simultaneously turned on, average beam current is altered when the duty cycle is altered. Average beam power is proportional to average beam current times the beam voltage which is a function of the distance over which charged particles are moved in an electric field, the electric field intensity and the charge of the particle. Average beam current is a function of the number of charged particles injected per unit time times the percentage of the total time the charged particle source is enabled, i.e., the duty cycle of the charged particle source. Therefore, by altering the duty cycle of the charged particle source and the RF source, the average beam current and average beam power can be precisely controlled. This has important implications in many applications for charged particle accelerators.

The second advantage of using the beam power controller, controllable beam energy, also has important implications in that it allows the LINAC to be used for some applications which it would not otherwise be useable for with a CW RF source. Specifically, when CW RF power sources are operated intermittently, the amplitude of the RF excitation waveform can be increased during the "on" portion of the duty cycle beyond the amplitude that would be allowable during continuous CW operation. This is because the components of the RF power source and high voltage power supply have the duration of the "off" portion of the duty cycle to cool off. If they did not have this "off" portion to cool off and rid themselves of the heat generated by the power dissipated therein during the "on" portion of the duty cycle; the temperatures of the various components would continuously rise until one or more components failed. The higher amplitude of the RF excitation waveform during the "on" portion of the duty cycle translates to higher peak power during the pulse. The higher peak power means that the charged particles leaving the accelerator during this pulse are faster. Faster particles translate to higher instantaneous beam energy and can also lead to higher average beam energy depending upon the relationship between the increase in RF excitation waveform amplitude versus the requirement for greater "off" time.

The third advantage of greater accelerator efficiency than pulsed RF source LINACs follows from the fact that LINAC efficiency is proportional to beam power divided by RF source power. Because the relative percentage of the total "on" time represented by the "fill" and "decay" times is less in a CW LINAC operated intermittently than in a pulsed RF source LINAC, efficiency is greater. This is because pulsed RF LINACs have very short pulses, typically measured in microseconds, compared to the pulse times of intermittently operated CW LINACs which are typically measured in milliseconds. Because the "fill" and "decay" times is approximately the same in both types of LINACs, the efficiency increase in the intermittently operated CW RF source LINAC is inevitable.

The RF source feeds the accelerator structure through an optional circulator 72 and a waveguide 74. Although the RF power is shown in FIG. 2 as being injected into the first cavity of the high speed section, the RF power can also be injected into any other of the cavities in either the low speed or high speed sections because the RF power redistributes itself in accordance with the coupling between the cavities. Use of a circulator is preferred because it prevents reflected power from being coupled back into the RF source 36 especially when arcing occurs in the LINAC. Arcing is not as common when the accelerator is well processed, but if arcing occurs, without a circulator, the reflected power can destroy the magnetron. Therefore, in some nonpreferred embodiments, the circulator can be eliminated, but in the preferred embodiment, it is present to protect the magnetron because arcing can occur even in a well processed LINAC. The processing techniques for building the LINAC are not part of the invention, and any well known methodology for building the structures of FIGS. 2 and 3 can be used to practice the invention. The invention lies in the structures of the accelerator cavities and their relationship to each other which provides the advantage of being able to use CW RF sources to accelerate low velocity particles efficiently.

The microwave source 36 is preferably a magnetron, but could also be a Klystron or travelling wave tube or other known microwave sources. CW magnetrons are available at 50 kW microwave power in the 3 GHz frequency range. The RF source 36 can be coupled to any of the resonator cavities in either the high or low velocity structures. The RF power source can also be coupled to the accelerator through a power splitter as described in reference 3 above.

Switch 70 could be a fast switch such as a triac to convert CW operation into pulsed operation using long pulses when pulse rise and fall times are not of great importance. A modulator for block 66 is preferred for low power pulsed operation.

After the beam is accelerated to the designed energy output, it can be re-distributed using a beam shaping device 76. This device can take the form of a magnetic or electrical lens, a scatterer, a quadruple, a scanner or a drift space. Finally, the beam may be applied to an output device 78 through, for example, a beam fan 80. Typical output devices include x-ray converters, aluminum foil, neutron converters, etc.

The RF linear accelerator of the structure of FIG. 2 has the following properties.

| | | |
|---|---|---|
| Loaded Electron Energy | $W_{OUT}$ | 1 MeV |
| Average Beam Current | $I_{AV}$ | 10 mA |
| Beam Power | $P_b$ | 10 kW |
| RF Power Source | $P_O$ | 30 kW Magnetron CW |
| Injection Energy | $W_O$ | 10–20 KeV |
| Efficiency | $\eta = \frac{P_B}{P_o}$ | 30% |
| Length of RF LINAC Structure | | 1 Meter |
| Shunt Impedance | $R_S$ | 100 MOhm/m |
| $Q_O$ | 16,000 | |

One skilled in the art will note that these parameters are outstanding performance for an RF LINAC using a CW RF power source and injection velocities for electrons of only about 0.2 C. One skilled in the art also will note from FIG. 2 that the extra complexity and expense of use of a prebuncher, focussing coils and two separate RF power sources has been eliminated. The prebuncher however, in alternative embodiments of the invention, still may be included as well as additional or higher power RF sources or amplifiers to achieve higher beam power at the accelerator output.

Figure 4:
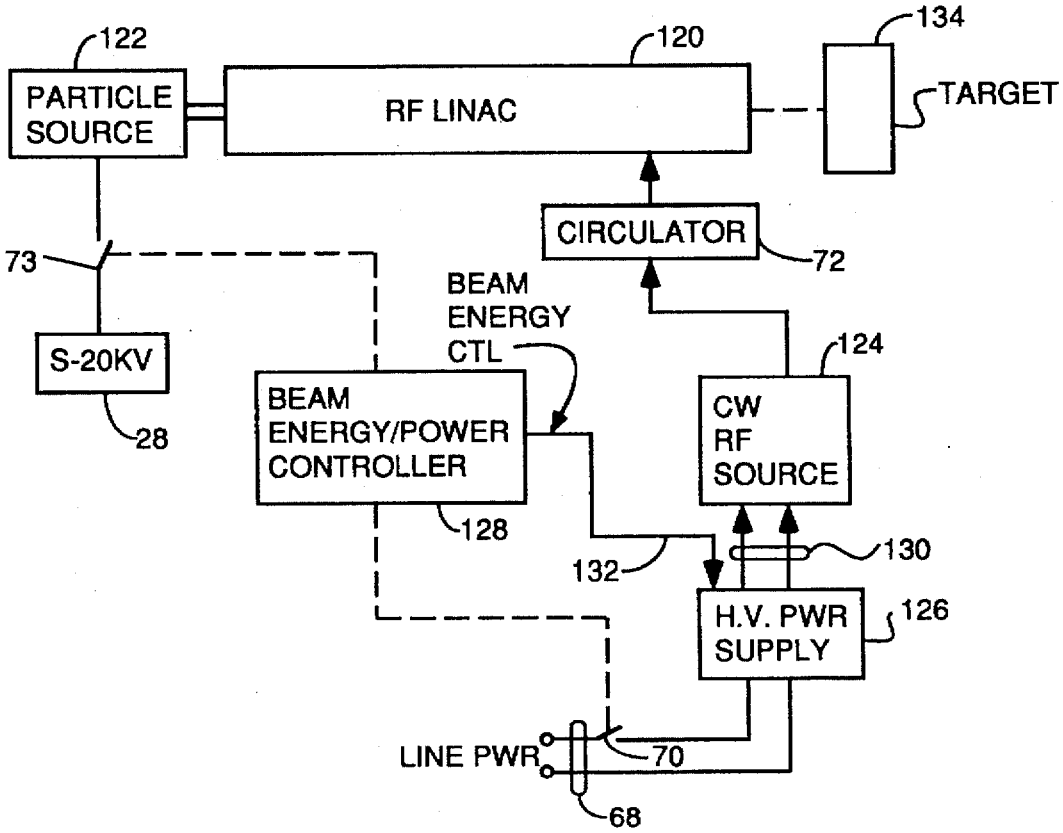
FIG. 4 is a block diagram of an RF LINAC with a CW RF source that is duty cycle controlled by a beam energy/power controller.

Referring to FIG. 4, there is shown a block diagram of a duty cycle controlled RF LINAC using a CW RF source which has several advantages over conventional CW RF LINACs. The RF LINAC 120 and its charged particle source 122 can be any conventional RF LINAC structure and charged particle source which is compatible with the lower amplitudes of CW RF sources. In addition, the RF LINAC and charged particle source may have the structure shown in FIG. 2 or any of the alternative forms thereof identified herein. A CW RF source 124 is powered by a high voltage power supply 126. The high voltage supply receives power from the A.C. power lines 68 through switch 70. Switch 70 is opened and closed by a beam power/energy controller 128. This beam power/energy controller 128 also controls the opened or closed state of a switch 73 that enables and disables the charged particle source 122 by controlling the power supplied thereto from a high voltage supply 28. The beam power/energy controller 128 can be operated to control the average beam power by controlling and synchronizing duty cycles of the charged particle source 122 and the CW RF source 124. In other words, intermittent pulsed operation can be achieved by using the beam power/energy controller to simultaneously close switches 70 and 73 to fill the accelerator with RF energy and simultaneously inject charged particles into the accelerator. In addition, the beam energy/power controller 128 can also be used to increase or decrease the output beam energy by controlling the amplitude of the high voltage supplied to the CW RF source 124 on lines 130 via a beam energy control signal on line 132. This control signal controls is coupled to a voltage regulator in the high voltage power supply 126 so as to control the output voltage on lines 130. The high voltage on lines 130 control the cathode-to-anode voltage applied to a magnetron in CW RF source 124. Raising the cathode-to-anode voltage causes the magnitude of the RF excitation energy supplied to the RF LINAC 120 through circulator 72 to increase thereby increasing the output beam energy. The beam energy/power controller 128 simultaneously decreases the duty cycles of the CW RF source 124 and the particle source 122 when the output beam energy is raised so that the average beam power stays within the design limits of the cooling system (not shown) that cools various components in the system of FIG. 4 such as the RF LINAC 120, target 134 and CW RF source 124.

In the preferred embodiment, the switches 70 and 73 are triacs, and the beam power/energy controller 128 can be a computer or any other circuit that turns both switches on in accordance with a duty cycle to achieve the desired output beam power. In some embodiments, the controller 128 can be more sophisticated in turning on switch 70 first, and then waiting some short time while the cavities fill with RF power and then turning on switch 73. Since the charged particles are accelerated mainly during the peaks of the RF power pulses, injection is done only during these times.

The presence of the beam power controller 128 and switches 70 and 73 gives the system of FIG. 4 added utility in several respects. First, the beam power/energy controller 128, by enabling modulation of the duty cycles of the CW RF power source 124 and the charged particle injection source 122 enables control of the average beam power. Second, by operating a CW source only intermittently, higher momentary beam energy is possible than is possible in RF LINACs having CW RF sources operated continuously. Higher beam energy widens the array of applications to which the charged particle accelerator can be put. Third, operating the accelerator with a CW RF source which is enabled intermittently with RF pulse lengths that are very long compared to the typical pulse lengths of pulsed RF sources increases the efficiency of the accelerator. This is because the "fill time" and "decay time" which translate roughly to the rise and fall times of the RF pulses. Fourth, operation of a CW RF source intermittently eases cooling requirements and makes the cooling system less expensive to build.

As to the first advantage of using beam power controller 128, average beam power is proportional to average beam current. Since the charged particle source is turned on by the beam power controller only when the RF source is simultaneously turned on, average beam current is altered when the duty cycle is altered. Average beam power is proportional to average beam current times the beam voltage which is a function of the distance over which charged particles are moved in an electric field, the electric field intensity and the charge of the particle. Average beam current is a function of the number of charged particles injected per unit time times the percentage of the total time the charged particle source is enabled, i.e., the duty cycle of the charged particle source. Therefore, by altering the duty cycle of the charged particle source and the RF source, the average beam current and average beam power can be precisely controlled. This has important implications in many applications for charged particle accelerators.

The second advantage of using the beam power controller, controllable beam energy, also has important implications in that it allows the LINAC to be used for some applications which it would not otherwise be useable for with a CW RF source. Specifically, when CW RF power sources are operated intermittently, the amplitude of the RF excitation waveform can be increased during the "on" portion of the duty cycle beyond the amplitude that would be allowable during continuous CW operation. This is because the components of the RF power source and high voltage power supply have the duration of the "off" portion of the duty cycle to cool off. If they did not have this "off" portion to cool off and rid themselves of the heat generated by the power dissipated therein during the "on" portion of the duty cycle, the temperatures of the various components would continuously rise until one or more components failed. The higher amplitude of the RF excitation waveform during the "on" portion of the duty cycle translates to higher peak power during the pulse. The higher peak power means that the charged particles leaving the accelerator during this pulse are faster. Faster particles translate to higher instantaneous beam energy and can also lead to higher average beam energy depending upon the relationship between the increase in RF excitation waveform amplitude versus the requirement for greater "off" time. The ability to control the duty cycle to allow sufficient natural cooling to occur by convection also simplifies the cooling system requirements and makes the cooling system cheaper to build.

The third advantage of greater accelerator efficiency than pulsed RF source LINACs follows from the fact that LINAC efficiency is proportional to beam power divided by RF source power. Because the relative percentage of the total "on" time represented by the "fill" and "decay" times is less in a CW LINAC operated intermittently than in a pulsed RF source LINAC, efficiency is greater. This is because pulsed RF LINACs have very short pulses, typically measured in microseconds, compared to the pulse times of intermittently operated CW LINACs which are typically measured in milliseconds. Because the "fill" and "decay" times is approximately the same in both types of LINACs, the efficiency increase in the intermittently operated CW RF source LINAC is inevitable.

Although the invention has been described in terms of a single preferred embodiment and a few alternative species, those skilled in the art will appreciate that numerous modifications and alternative structures could be substituted for the structures described or identified herein. All such modifications are intended to be included within the scope of the claims appended hereto.

What is claimed is:

1. An RF linear accelerator comprising:

a charged particle source supplying charged particles having velocities substantially lower than the minimum particle injection velocity needed for efficient acceleration in a conventional RF linear accelerator which does not use drift tubes;

a first RF linear accelerator having one or more resonator cavities each with a drift tube therein coupled to receive charged particles from said charged particle source and structured to accelerate them from whatever velocity they arrived to a minimum velocity needed for efficient acceleration in an RF linear accelerator that does not use drift tubes;

a second RF linear accelerator which has one or more resonator cavities which do not employ drift tubes, said second RF accelerator coupled to receive charged particles output from said first RF linear accelerator said second RF linear accelerator structured for accelerating said charged particles arriving from said first RF linear accelerator up to a relativistic velocity;

an RF source of microwave energy coupled to said first and second RF linear accelerators so as to excite therein the $TM_{010}$ mode; and a coupling structure coupling said $TM_{010}$ RF energy in said first linear accelerator to said second linear accelerator in such a way as to cause a phase change such that charged particles arriving from said first RF linear accelerator arrive at a first resonator cavity of said second RF linear accelerator at a time when the electric field of said $TM_{010}$ mode in said first resonator cavity of said second RF linear accelerator is oriented in such a way as to accelerate said charged particles.

2. The apparatus of claim 1 wherein coupling cavities are used to couple RF energy between adjacent resonator cavities in each of said first and second linear accelerators.

3. The apparatus of claim 2 wherein said coupling cavities are not on the axis of the accelerated particle beam so as to increase the RF path length but not appreciably increase the particle beam path length through the first and second accelerators.

4. The apparatus of claim 1 wherein said charged particle source is structured to supply charged particles at approximately 0.1 C and wherein said first and second RF linear accelerators and said coupling structure are configured to accelerate said charged particles from approximately 0.1 C to relativistic velocities near the velocity of light in a vacuum.

5. The apparatus of claim 1 wherein said resonator cavities in said first RF linear accelerator are sized relative to the size of the drift tube and the average velocity of charged particles in said accelerator cavity and the wavelength of the signal generated by said RF source such that the electric fields of said $TM_{010}$ mode oscillate in phase in the gaps on either side of said drift tube with phase shift θ, equal to 2Πn, where n is an integer.

6. The apparatus of claim 2 wherein said coupling cavities of said first linear accelerator are located such that said first linear accelerator is on-axis coupled and wherein said resonator cavities and said coupling cavities in said first linear accelerator define a periodic structure having a period L for each resonator cavity/coupling cavity/combination equal to:

$$L=\frac{5\beta\lambda_o}{2}$$

where

β is the average velocity of charged particles in meters per second in a particular resonator cavity relative to the velocity of light in a vacuum, and $\lambda_O$ is the wavelength in free space in meters of the signal generated by said RF source and wherein the length D of each drift tube in a resonator cavity is:

$$D=(0.5\pm0.15)\beta\ \lambda_O$$

where

β and $\lambda_O$ are as defined above.

7. The apparatus of claim 2 wherein said coupling cavities of said first linear accelerator are located such that said first linear accelerator is off-axis coupled and wherein said resonator cavities and said coupling cavities in said first linear accelerator define a periodic structure having a period L where L is the length of the resonator cavity in the off-axis coupled first linear accelerator and is equal to:

$$L=\frac{3\beta\lambda_o}{2}$$

where

β is the average velocity of charged particles in meters per second in a particular resonator cavity relative to the velocity of light in a vacuum, and $\lambda_O$ is the wavelength in free space in meters of the signal generated by said RF source and wherein the length D of each drift tube in a resonator cavity is:

$$D=(0.5\pm0.15)\beta\ \lambda_O$$

where

β and $\lambda_O$ are as defined above for the length L of the resonator cavity.

8. An RF linear accelerator comprising:

a charged particle source;

a first RF linear accelerator section structured to accelerate charged particles for velocities of approximately 0.1 C to 0.5 C using a CW or low amplitude pulsed RF source and drift tubes;

a second RF linear accelerator section structured to accelerate charged particles received from said first RF linear accelerator from velocities of approximately 0.5 C up to relativistic velocities of 0.9 C and above using a CW or low amplitude pulsed RF source;

a CW or low amplitude RF source coupled to both said first and second RF liner accelerators to generate microwave signals which excite a $TM_{010}$ standing wave in said first and second linear accelerators; and a coupling structure to couple said $TM_{010}$ standing wave energy from said first to said second linear accelerator so as to cause sufficient phase change seen by charged particles entering said second RF linear accelerator from said first RF linear accelerator so as to cause further acceleration of said charged particles in said second RF linear accelerator.

9. An RF linear accelerator comprising:

means for supplying charged particles having a velocity of approximately 0.1 C;

first means for receiving said charged particles and accelerating them from their velocity of arrival to a velocity of about 0.5 C using; a CW or low pulse amplitude RF source second means for receiving charged particles accelerated by said first means and accelerating them from whatever velocity they arrived from said first means to relativistic velocities near the velocity of light using a CW or low pulse amplitude RF source; and means for supplying CW or low pulse amplitude RF energy to said first and second means.

10. An RF linear accelerator comprising:

a source of charged particles having a velocity which is too low for RF accelerators without drift tubes and CW RF sources to accelerate;

a first RF LINAC coupled to receive said charged particles and having a structure including drift tubes configured so as to accelerate said particles from the velocity at which they arrive up to a velocity at which they can be accelerated by RF LINACs having no drift tubes and CW or low pulse amplitude RF sources;

a second RF LINAC coupled to receive accelerated charged particles from said first RF LINAC and structured so as to accelerate said charged particles from whatever velocity at which they arrive up to relativistic velocities; an RF source of either a CW or low pulse amplitude design;

a power splitter coupling a portion of the RF power from said RF power source to each of said first and second RF LINACs to excite a standing wave therein and for providing a relative phase shift between the output of said first RF linear accelerator and the input of said second RF linear accelerator so as to maintain synchronization.

11. The apparatus of claim 10 wherein said power splitter is structured to provide a variable power ratio of the RF power supplied to said first and second RF LINACs, respectively.

12. The apparatus of claim 10 wherein said power splitter is structured to provide a variable relative phase shift between the output of said first RF LINAC and the input of said second RF LINAC.

13. The apparatus of claim 10 wherein said power splitter is structured to provide a fixed amount of phase shift between the output of said first RF LINAC and the input of said second RF LINAC but to control the relative amplitude of RF excitation energy supplied to each of said first and second RF LINACs.

14. The apparatus of claim 13 wherein said power splitter includes a power regulator configured to provide a variable, regulated amount of power to at least said second RF LINAC so as to control the amount of acceleration occurring therein.

15. A process for accelerating charged particles comprising:

providing charged particles having a velocity which is too low to accelerate in RF LINAC resonators without drift tubes using a CW RF source;

passing said charged particles through a CW standing wave pattern in one or more first type resonator cavities each having a drift tube therein and coupled by RF coupling cavities such that said charged particles are, in each first type resonator cavity, subjected to accelerating electric fields in the gaps on either side of each drift tube and shielded from decelerating electric fields while travelling through said drift tubes;

passing said charged particles through a CW standing wave in one or more second type resonator cavities without drift tubes and RF coupled by coupling cavities such that said charged particles arrive at an input of the first of said second type resonator cavities in predetermined degree of synchronization with oscillations of said standing wave such that said charged particles are accelerated to relativistic velocities.

16. The process of claim 15 wherein the degree of synchronization of arrival of said charged particles with the time of maximum acceleration in the first of said second type of resonator cavities can be varied by coupling RF excitation energy between said first and second type resonator cavities through a coupling device that provides a variable amount of relative phase shift between the standing wave in the first type resonator cavities and the standing wave in the second type resonator cavities.

17. An RF linear accelerator comprising:

a charged particle source supplying charged particles having velocities substantially lower than the minimum particle injection velocity needed for efficient acceleration in a conventional RF linear accelerator which does not use drift tubes;

a first RF linear accelerator having one or more resonator cavities each with a drift tube therein coupled to receive charged particles from said charged particle source and structured to accelerate them from whatever velocity they arrived to a minimum velocity needed for efficient acceleration in an RF linear accelerator that does not use drift tubes;

a second RF linear accelerator which has one or more resonator cavities which do not employ drift tubes, said second RF accelerator coupled to receive charged particles output from said first RF linear accelerator, said second RF linear accelerator structured for accelerating said charged particles arriving from said first RF linear accelerator up to a relativistic velocity;

a CW RF source of microwave excitation energy in the form of an RF waveform coupled to said first and second RF linear accelerators so as to excite therein the $TM_{010}$ mode; and a coupling structure coupling said $TM_{010}$ RF energy in said first RF linear accelerator to said second RF linear accelerator in such a way as to cause a phase change such that charged particles arriving from said first RF linear accelerator arrive at a first resonator cavity of said second RF linear accelerator at a time when the electric field of said $TM_{010}$ mode in said first resonator cavity of said second RF linear accelerator is oriented in such a way as to accelerate or decelerate said charged particles at the choice of the operator; and switching means for enabling and disabling said CW RF source and said charged particle source so as to control the duty cycle of each so as to facilitate control of average output beam power by varying said duty cycles.

18. The apparatus of claim 17 wherein coupling cavities are used to couple RF energy between adjacent resonator cavities in each of said first and second RF linear accelerators.

19. The apparatus of claim 18 wherein said coupling cavities are not on the axis of the accelerated particle beam so as to increase the RF path length but not appreciably increase the particle beam path length through the first and second accelerators.

20. The apparatus of claim 17 wherein said charged particle source is structured to supply charged particles at approximately 0.1 C and wherein said first and second RF linear accelerators and said coupling structure are configured to accelerate said charged particles from approximately 0.1 C to relativistic velocities near the velocity of light in a vacuum.

21. The apparatus of claim 17 wherein said resonator cavities in said first RF linear accelerator are sized relative to the size of the drift tube and the average velocity of charged particles in said accelerator cavity and the wavelength of the signal generated by said RF source such that the electric fields of said $TM_{010}$ mode oscillate in phase in the gaps on either side of said drift tube with phase shift θ, equal to 2Πn, where n is an integer.

22. The apparatus of claim 18 wherein said resonator cavities and said coupling cavities in said first linear accelerator define a periodic structure having a period L for each resonator cavity/coupling cavity/combination equal to:

$$L=\frac{5\beta\lambda_o}{2}$$

where

β is the average velocity of charged particles in meters per second in a particular resonator cavity relative to the velocity of light in a vacuum, and $\lambda_O$ is the wavelength in free space in meters of the signal generated by said RF source and wherein the length D of each drift tube in a resonator cavity is:

$$D=(0.5\pm0.15)\beta\,\lambda_O$$

where

β and $\lambda_O$ are as defined above.

23. The apparatus of claim 17 wherein said coupling structure comprises means for controlling the phase change between said first and second RF linear accelerators and the relative amplitude of the RF waveform excitation energy supplied to said second RF linear accelerator relative to said first RF linear accelerator.

24. The apparatus of claim 18 wherein said coupling cavities of said first linear accelerator are located such that said first linear accelerator is off-axis coupled and wherein said resonator cavities and said coupling cavities in said first linear accelerator define a periodic structure having a period L where L is the length of the resonator cavity in the off-axis coupled first linear accelerator and is equal to:

$$L=\frac{3\beta\lambda_o}{2}$$

where $\beta$ is the average velocity of charged particles in meters per second in a particular resonator cavity relative to the velocity of light in a vacuum, and $\lambda_o$ is the wavelength in free space in meters of the signal generated by said RF source and wherein the length D of each drift tube in a resonator cavity is:

$$D=(0.5\pm0.15)\beta\,\lambda_o$$

where $\beta$ and $\lambda_o$ are as defined above for the length L of the resonator cavity.

25. An apparatus comprising:

an RF linear accelerator structure;

a CW RF source coupled to said RF linear accelerator so as to supply RF energy thereto when said CW RF source is enabled;

a charged particle source coupled to supply charged particles to said RF linear accelerator when said charged particle source is enabled;

a first switch coupled to enable or disable said CW RF source;

a second switch coupled to enable or disable said charged particle source; and a beam energy/power controller coupled to said first and second switches so as to control the duty cycles for enabling and disabling of said CW RF source and said charged particle source so as to achieve a desired average output beam power from said RF linear accelerator.

26. The apparatus of claim 25 further comprising a cooling system coupled to at least said RF LINAC, said cooling system having a rated power dissipation capability, and wherein said CW RF source includes a high voltage supply which is capable of supplying a variable high voltage for use by said CW RF source in generating said RF energy the magnitude of said variable high voltage which is generated being responsive to a beam energy control signal, and wherein said beam energy/power controller also generates said beam energy control signal so as to cause the amplitude of said variable high voltage to be altered so as to achieve a desired beam energy for said output beam, and wherein said beam energy/power controller also alters said duty cycles of said CW RF source and said charged particle source when the magnitude of said variable high voltage is altered so as to achieve an average output beam power from said RF linear accelerator which is within said rated power dissipation capability of said cooling system.

* * * * *